US008936348B1

(12) United States Patent
Nakata et al.

(10) Patent No.: US 8,936,348 B1
(45) Date of Patent: Jan. 20, 2015

(54) RECORDING APPARATUS

(71) Applicant: Seiko Epson Corporation, Tokyo (JP)

(72) Inventors: Satoshi Nakata, Matsumoto (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/262,310

(22) Filed: Apr. 25, 2014

(30) Foreign Application Priority Data

Jul. 8, 2013 (JP) ..... 2013-142739

(51) Int. Cl.
*B41J 23/00* (2006.01)
*B41J 25/308* (2006.01)

(52) U.S. Cl.
CPC ..... *B41J 25/308* (2013.01)
USPC ..... 347/37

(58) Field of Classification Search
CPC ..... B41J 2/04; B41J 25/3082; B41J 25/308; B41J 19/202; B41J 25/3088; B41J 2/17509
USPC ..... 347/8, 16, 37, 101, 104
See application file for complete search history.

(56) References Cited

U.S. PATENT DOCUMENTS 7,695,101 B2 * 4/2010 Samoto et al. ..... 347/37
8,820,869 B2 * 9/2014 Kumagai et al. ..... 347/8

FOREIGN PATENT DOCUMENTS

JP 2013-046972 3/2013

* cited by examiner

*Primary Examiner* — An Do
(74) *Attorney, Agent, or Firm* — Workman Nydegger

(57) ABSTRACT

A sliding section that slides on a guide rail to which grease is applied while integrally moving with a carriage is provided in a side surface of the carriage that is equipped with a liquid ejecting head and reciprocates in a moving direction. The sliding section has one side edge section extending so as to cross the moving direction in a position of one side in the moving direction, and the other side edge section extending so as to cross the moving direction in a position of the other side in the moving direction.

7 Claims, 9 Drawing Sheets

RECORDING APPARATUS

BACKGROUND

1. Technical Field

The present invention relates to a recording apparatus including a sliding section that slides on a guide section when a moving body equipped with a recording section moves in a main scanning direction by being guided by the guide section.

2. Related Art

In related art, as a type of a recording apparatus, a printer is disclosed in which a sliding member (sliding section) comes into contact with a guide rail extending in a main scanning direction of a medium through lubricant such as grease in a carriage (moving body) that is equipped with a liquid ejecting head (recording section) and reciprocates (for example, see JP-A-2013-46972).

That is, the sliding member provided in the carriage in the printer has one side edge section extending so as to cross the main scanning direction in a position of one side in the main scanning direction, and the one side edge section has a divergent edge shape in which one end side portion and the other end side portion are positioned on one side in the main scanning direction from a nearly center portion in a direction crossing the main scanning direction. Thus, when the carriage is moved to one side in the main scanning direction, it is possible to scrape up the grease applied to the guide rail by the one side edge section having the divergent edge shape in the sliding member.

However, in the printer described above, usually, the carriage equipped with the liquid ejecting head reciprocates along the main scanning direction when printing is performed with respect to the medium. Thus, when the carriage moves to one side in the main scanning direction, the grease applied to the guide rail can be scraped up by the one side edge portion of the sliding member, but when the carriage moves to the other side in the main scanning direction, the grease applied to the guide rail cannot be scraped up by the sliding member. As a result, oil between the guide rail and the sliding member which slides when the carriage is moved cannot be ensured, and there is a concern that the guide rail or the sliding member will wear.

Moreover, such a problem is assumed to be almost common to recording apparatuses in which lubricant or the like is interposed between the sliding member and the guide section.

SUMMARY

An advantage of some aspects of the invention is to provide a recording apparatus capable of suppressing wear of a guide section or a sliding section by ensuring oil between the guide section and the sliding section which slides when a moving body is moved.

Hereinafter, means of the invention and operation effects thereof will be described.

According to an aspect of the invention, a recording apparatus includes: a recording section that performs recording with respect to a medium; a moving body that is equipped with the recording section and reciprocates with respect to the medium in a main scanning direction; a guide section that extends in the main scanning direction and guides movement of the moving body in the main scanning direction; and a sliding section that is provided so as to integrally move with the moving body and slides on the guide section to which a lubricant is applied when the moving body is moved. The sliding section has one side edge section that extends so as to cross the main scanning direction in a position of one side in the main scanning direction and the other side edge section that extends so as to cross the main scanning direction in a position of the other side in the main scanning direction. In the one side edge section, one end side portion and the other end side portion in a direction crossing the main scanning direction are positioned on the one side in the main scanning direction from a nearly center portion. In the other side edge section, one end side portion and the other end side portion in a direction crossing the main scanning direction are positioned on the other side in the main scanning direction from a nearly center portion.

In this case, if lubricant is applied to a surface of the guide section on which the sliding section slides when the moving body is moved, even when the moving body is moved in either direction of to the one side and to the other side in the main scanning direction, it is possible to collect the lubricant in the vicinity of the nearly center portion between the one end side portion and the other end side portion in the edge section thereof by either of the one side edge section and the other side edge section of the sliding section. Therefore, it is possible to suppress wear of the guide section or the sliding section by ensuring oil between the guide section and the sliding section which slides when the moving body is moved.

It is preferable that the recording apparatus further include a support section that has a support surface capable of supporting the medium in a state of facing the recording section; and a gap adjustment section that is capable of adjusting a gap between the support surface and the recording section by displacing the moving body in a direction in which the support surface faces the recording section, in which in a state where the moving body is displaced until a displaceable limit position in a direction in which the support surface faces the recording section according to adjustment of the gap by the gap adjustment section, each edge section of the sliding section maintains a state where at least one of the one end side portion and the other end side portion, and the nearly center portion are capable of sliding with respect to the guide section.

In this case, even when the gap between the support surface and the recording section is adjusted by the gap adjustment section, and the moving body is displaced until the limit position in which the moving body is capable of being displaced in the direction in which the support surface faces the recording section, it is possible to collect the lubricant in the vicinity of the nearly center portion in each edge section of the sliding section. It is possible to suppress wear of the guide section or the sliding section by oil.

It is preferable that in a case where the moving body be displaced in a vertical direction according to the adjustment of the gap by the gap adjustment section, when the moving body is displaced until the upper limit position, each edge section of the sliding section maintain a position state in which at least a part of edge portions connecting portions which are positioned on the upper side of the one end side portion and the other end side portion, and the nearly center portions is capable of sliding on the guide section, and when the moving body is displaced until the lower limit position, each edge section of the sliding section maintain a position state in which at least a part of edge portions connecting portions which are positioned on the lower side of the one end side portion and the other end side portion, and the nearly center portions is capable of sliding on the guide section.

In this case, even when the moving body is displaced to the upper limit position or the lower limit position according to the gap adjustment by the gap adjustment section, it is possible to collect the lubricant in the vicinity of the nearly center portion from both sides of the one end side and the other end side in each edge section of the sliding section.

It is preferable that in at least one edge section of the one side edge section and the other side edge section of the sliding section, a concave section be provided between the one end side portion and the other end side portion, and the nearly center portion.

In this case, since the lubricant that is scraped up from a surface of the guide section by the one side edge section and the other side edge section of the sliding section is collected in the concave section according to the movement of the moving body, it is possible to secure the oil between a guide section and the sliding section by the lubricant stored in the concave section.

It is preferable that the sliding section be configured of a plurality of sliding sections provided adjacent to each other in the main scanning direction across a groove section extending in a direction crossing the main scanning direction.

In this case, it is possible to ensure oil between the guide section and the sliding section by the lubricant flowed and collected into the groove section after the lubricant flows into the groove section between both sliding sections adjacent to each other in the main scanning direction.

It is preferable that the sliding section have a concave section of which a circumference is surrounded by a circular edge section between the one side edge section and the other side edge section in the main scanning direction.

In this case, since the sliding section can utilize the concave section surrounded by the circular edge section as a lubricant reservoir, in this respect, it is possible to ensure oil between a guide section and the sliding section.

It is preferable that the sliding section include a vertical sliding section that slides on a vertical surface with respect to the guide section and a horizontal sliding section that slides on a horizontal surface with respect to the guide section, and when the lubricant is applied between each sliding section and the guide section, an applied amount of the lubricant between the vertical sliding section and the guide section be greater than that of the lubricant between the horizontal sliding section and the guide section.

In this case, although the lubricant applied between the vertical sliding section and the guide section is likely to flow out from between the vertical sliding section and the guide section by being affected by gravity, it is possible to secure the ensuring of oil between the vertical sliding section and the guide section by a relatively large amount of the lubricant applied to such places over a long period of time.

BRIEF DESCRIPTION OF THE DRAWINGS

The invention will be described with reference to the accompanying drawings, wherein like numbers reference like elements.

FIG. 5A is a perspective view of a first slide member, FIG. 5B is a perspective view of a first cam member, FIG. 5C is a rear view of the first cam member, and FIG. 5D is a perspective view of an engagement member.

FIG. 6A is a front view of a second slide member, and FIG. 6B is a front view of a second cam member.

DESCRIPTION OF EXEMPLARY EMBODIMENTS

Hereinafter, an embodiment in which a recording apparatus is embodied in an ink jet type printer is described with reference to the drawings.

Figure 1:
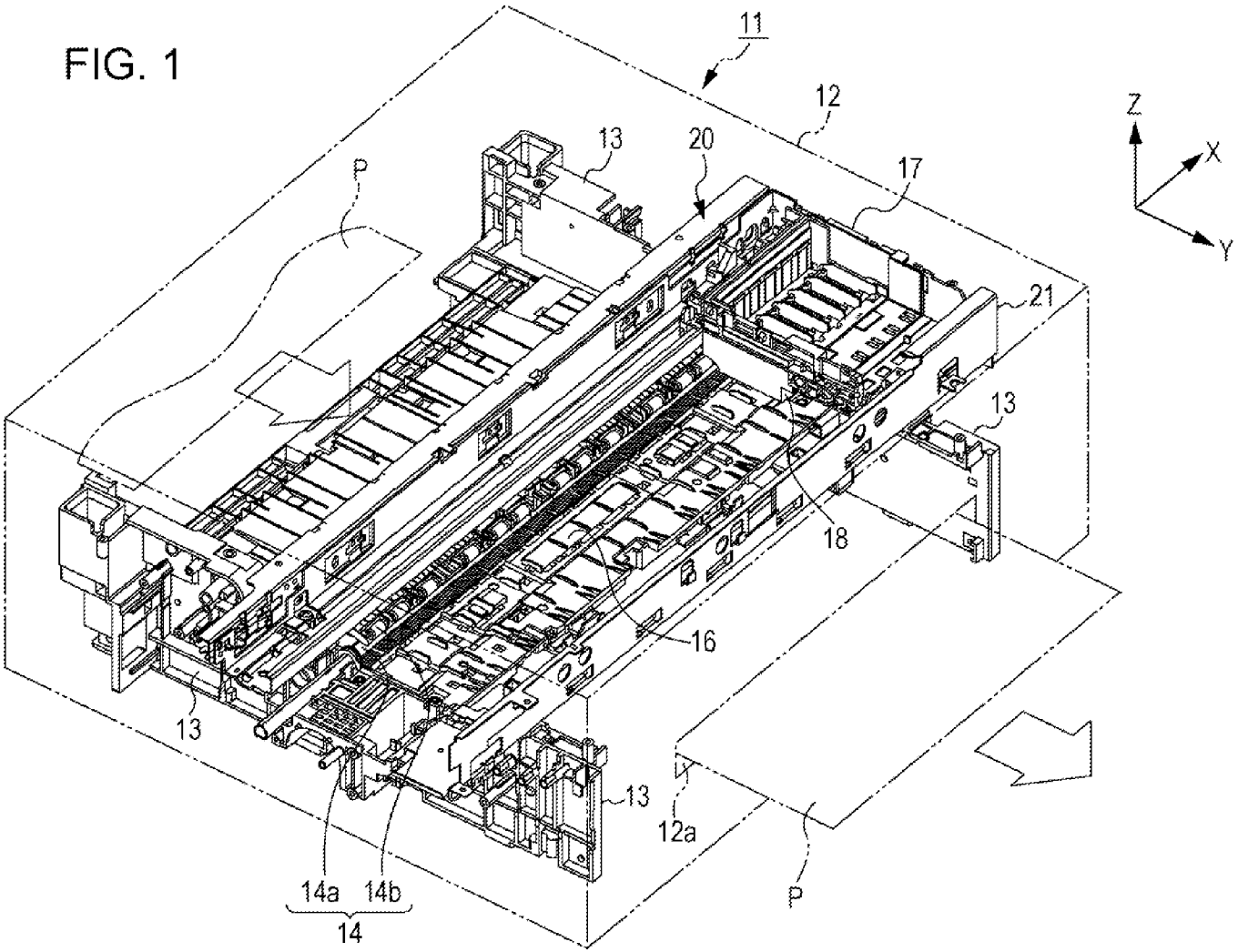
FIG. 1 is a perspective view of a printer of an embodiment.

As illustrated in FIG. 1, a printer 11 of the embodiment includes a base frame 13 on a bottom section inside an outer case 12 that exhibits a substantially rectangular parallelepiped shape. In the base frame 13, a transportation path of a sheet P that is an example of a medium is formed and the sheet P is transported in a transportation direction Y as indicated in a void arrow in the view. That is, the sheet P is transported in the transportation direction Y toward a support base 16 that is an example of a support section formed on an upper side in the base frame 13 that is a side of a direction opposite to gravity in a vertical direction Z while being clamped by a pair of transportation rollers 14 formed of a feeding roller 14*a* that is rotationally driven by a driving source (not illustrated) and a driven roller 14*b*. Then, the transported sheet P is transported while a side of a lower surface thereof that is a side of the gravity direction is supported on the support base 16.

In the printer 11, a direction along an upper surface of the support base 16 and crossing the transportation direction Y of the sheet P is referred to as a moving direction (a main scanning direction) X and the printer 11 includes a carriage 17 that is an example of a moving body capable of reciprocating along the moving direction X. That is, the carriage 17 is guided by a first guide rail 20 and a second guide rail 21 mounted on the base frame 13 so that the moving direction X of the carriage 17 is a longitudinal direction thereof, and reciprocates on the support base 16 in the moving direction X.

Figure 2A:
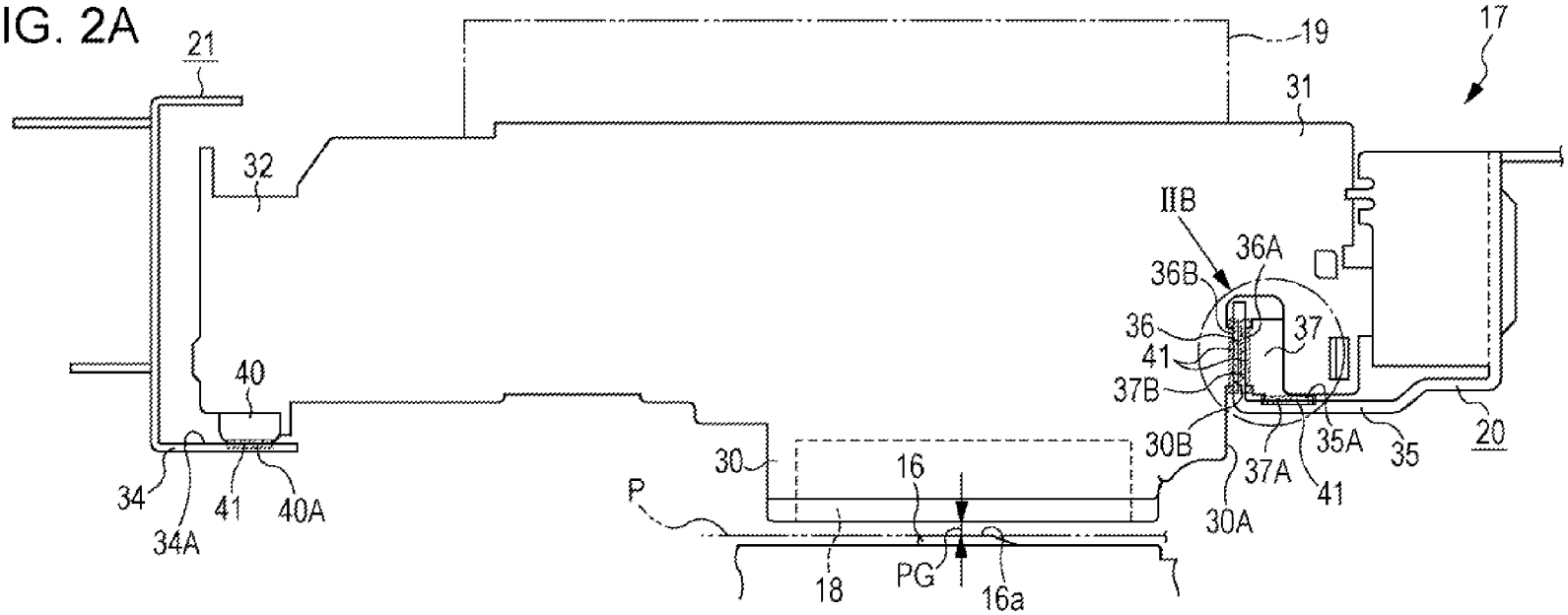
FIG. 2A is a side view of a carriage and FIG. 2B is a partial enlarged view thereof in circle IIB.

Further, as illustrated in FIG. 2A, on the carriage 17, a liquid ejecting head 18 capable of ejecting ink is installed, and an ink cartridge 19 that is an example of a fluid storage body that is capable of storing the ink is mounted. Then, the ink is supplied from the ink cartridge 19 mounted on the carriage 17 to the liquid ejecting head 18.

The first guide rail 20 and the second guide rail 21 are formed of plate members, respectively and are disposed in the base frame 13 having a distance therebetween in the transportation direction Y. That is, when comparing the first guide rail 20 and the second guide rail 21, the first guide rail 20 is positioned on the upstream side in the transportation direction Y and the second guide rail 21 is positioned on the downstream side in the transportation direction Y. Then, the first guide rail 20 and the second guide rail 21 support the carriage 17 from the side of the gravity direction in both sides across the liquid ejecting head 18 in the transportation direction Y in a state where the carriage 17 is movable in the moving direction X.

When the carriage 17 is moved by being guided by the first guide rail 20 and the second guide rail 21, the liquid ejecting head 18 moves having a predetermined gap PG between a support surface 16*a* of the support base 16 and the liquid ejecting head 18. Then, ink that is supplied from the ink cartridge 19 is ejected from nozzles (not illustrated) provided on a lower surface side of the liquid ejecting head 18 during moving thereof to the sheet P that is transported on the support base 16, thereby printing the image. The sheet P on which the image is printed is discharged from a discharge port 12*a* provided in the outer case 12 in the front side that is the other side of the transportation direction Y.

As illustrated in FIG. 2A, the carriage 17 includes a substantially rectangular box-shaped main support section 30 that supports the liquid ejecting head 18 and a first sub-support section 31 and a second sub-support section 32 which are integrally formed with respect to the main support section 30. The first sub-support section 31 and the second sub-support section 32 are disposed respectively on one side (the right side in FIG. 2A) and the other side (the left side in FIG. 2A) across the main support section 30 in the longitudinal direction of the carriage 17. Then, the first sub-support section 31 is supported by the first guide rail 20. Further, the second sub-support section 32 is supported from below by the second guide rail 21.

Figure 2B:
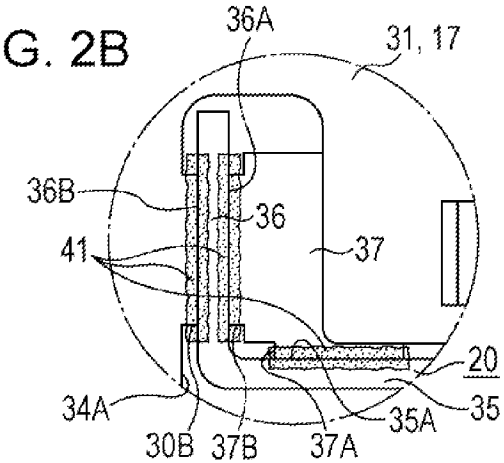

The first guide rail 20 has a first guide section 35 that extends parallel to the horizontal surface and a strip-shaped second guide section 36 that is formed along the vertical direction by bending a one side portion (the left side portion in FIGS. 2A and 2B) thereof going along the longitudinal direction of the first guide section 35 in a right angle upward.

Then, the first sub-support section 31 of the carriage 17 is supported on an upper surface 35A of the first guide section 35 through a block-shaped first slide member 37. The first slide member 37 is configured of a resin having a low frictional resistance with respect to the first guide section 35 and a sliding section 37A that slides on the upper surface 35A of the first guide section 35 is formed on a lower surface thereof so as to protrude. Further, the upper surface 35A of the first guide section 35 is a slide section on which the sliding section 37A formed on the lower surface of the slide member 37 that integrally moves with the carriage 17 slides in the moving direction X of the carriage 17. That is, the first guide section 35 in the first guide rail 20 functions as a guide section that guides the moving of the carriage 17 in the moving direction X while sliding the sliding section 37A of the first slide member 37 on the upper surface 35A thereof.

In the second guide section 36 going along the vertical direction, a sliding section 37B formed so as to protrude to the front surface of the first slide member 37 comes into contact with a first surface 36A facing the first slide member 37 in the horizontal direction. Then, the first surface 36A of the second guide section 36 is a slide section on which the sliding section 37B formed on the front surface of the first slide member 37 slides in the moving direction X of the carriage 17. Further, a sliding section 30B formed so as to protrude from a side surface 30A of the main support section 30 of the carriage 17 comes into contact with a second surface 36B on the opposite side to the first surface 36A in the second guide section 36. Then, the second surface 36B of the second guide section 36 is a slide section on which the sliding section 30B formed on the side surface 30A of the main support section 30 of the carriage 17 slides in the moving direction X of the carriage 17. In this point, the second guide section 36 in the first guide rail 20 functions as a guide section guiding the moving of the carriage 17 in the moving direction X while sliding the sliding section 37B of the first slide member 37 and the sliding section 30B of the carriage 17 on the first surface 36A and the second surface 36B.

Figure 3:
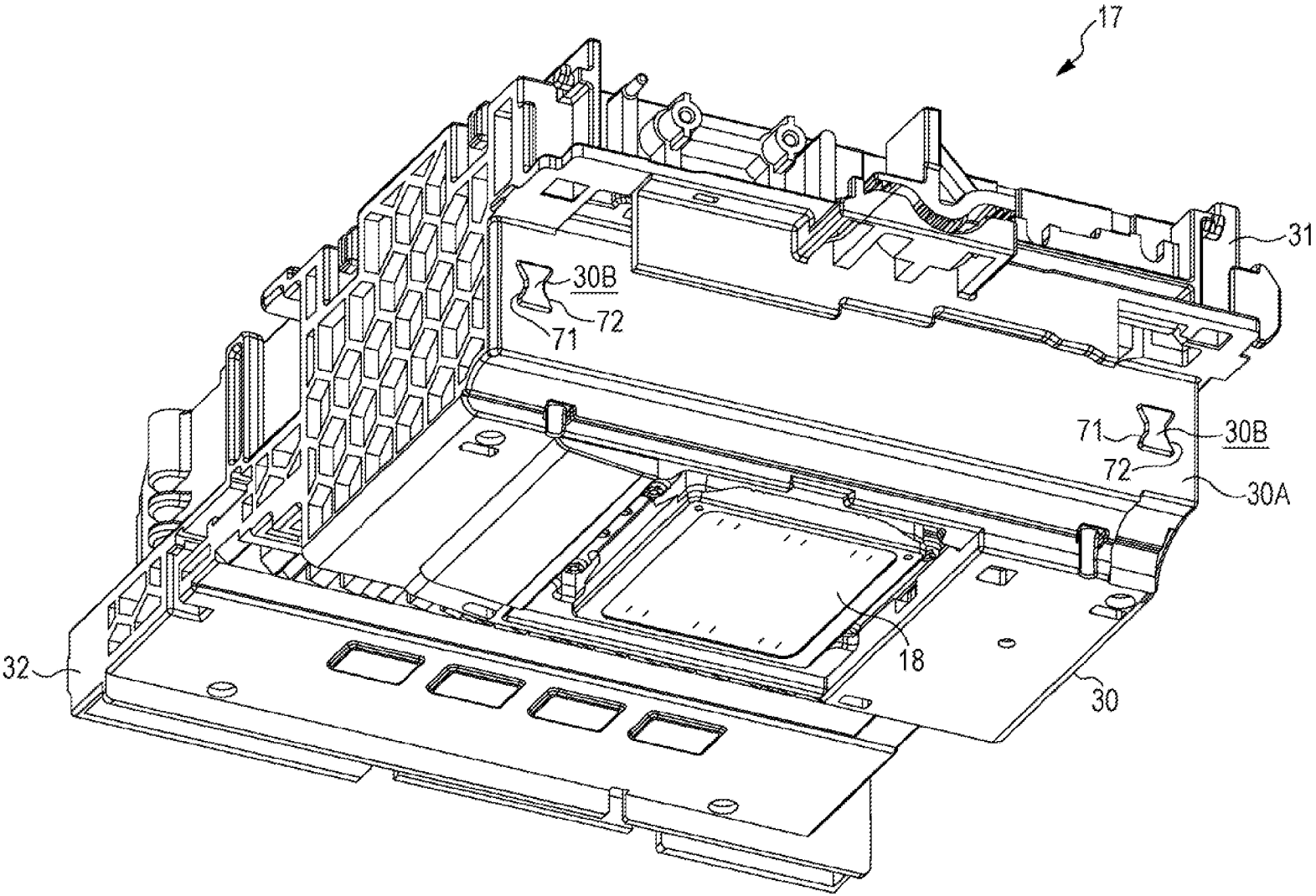
FIG. 3 is a perspective view of the carriage viewed from obliquely below.

Moreover, as illustrated in FIG. 3, the side surface 30A of the main support section 30 of the carriage 17 is an elongated rectangular plane section extending along the moving direction X and the sliding section 30B is formed in each position that is near both ends in the longitudinal direction in the side surface 30A thereof so as to protrude from the planar side surface 30A. A specific configuration of the sliding section 30B is described below in detail.

On the other hand, the second guide rail 21 has a strip-shaped guide section 34 extending parallel to the horizontal surface and the second sub-support section 32 of the carriage 17 is supported on an upper surface 34A of the guide section 34 thereof through a block-shaped second slide member 40. The second slide member 40 is configured of a resin having a low frictional resistance with respect to the guide section 34 and a sliding section 40A sliding with respect to the upper surface 34A of the guide section 34 is formed on a lower surface thereof so as to protrude. Further, the upper surface 34A of the guide section 34 is a slide section on which the sliding section 40A formed on the lower surface of the second slide member 40 that integrally moves with the carriage 17 slides in the moving direction X of the carriage 17. In this point, the second guide section 34 in the second guide rail 21 functions as a guide section guiding the moving of the carriage 17 in the moving direction X while sliding the sliding section 40A of the second slide member 40 on the upper surface 34A thereof.

Further, grease 41 as a lubricant reducing a load when the carriage 17 slides on each of the guide rails 20 and 21 in the moving direction X, is interposed between the sliding sections 30B, 37A, 37B and 40A formed in the carriage 17 and each of the slide members 37 and 40, and the slide sections of the first guide rail 20 and the second guide rail 21. That is, the grease 41 is interposed between the sliding section 37A of the first slide member 37 and the upper surface 35A of the first guide section 35, and between the sliding section 37B of the first slide member 37 and the first surface 36A of the second guide section 36. Further, the grease 41 is interposed between the sliding section 30B formed in the side surface 30A of the main support section 30 of the carriage 17 and the second surface 36B of the second guide section 36, and between the sliding section 40A of the second slide member 40 and the upper surface 34A of the guide section 34.

Moreover, the sliding section 30B formed on the side surface 30A of the main support section 30 of the carriage 17 and the sliding section 37B formed on the side surface of the first slide member 37 slide on the vertical surface with respect to the strip-shaped second guide section 36 going along the vertical direction so that they function as vertical sliding sections. On the other hand, the sliding section 37A formed on the lower surface of the first slide member 37 and the sliding section 40A formed on the lower surface of the second slide member 40 slide with respect to the strip-shaped guide sections 34 and 35 going along in the horizontal direction in the horizontal surface so that they function as horizontal sliding sections. Further, in an amount of the grease interposed between each of the sliding sections 30B, 37A, 37B and 40A, and each of the guide sections 34, 35 and 36, the amount of the grease between the sliding sections 30B and 37B, and the guide section 36 functioning as the vertical sliding section is greater than that of the grease between the sliding sections 37A and 40A, and the guide sections 34 and 35 functioning as the horizontal sliding section. This is because the amount of the grease in the vertical sliding section that flows down by gravity is considered to be greater than that of the grease in the horizontal sliding section.

Figure 4:
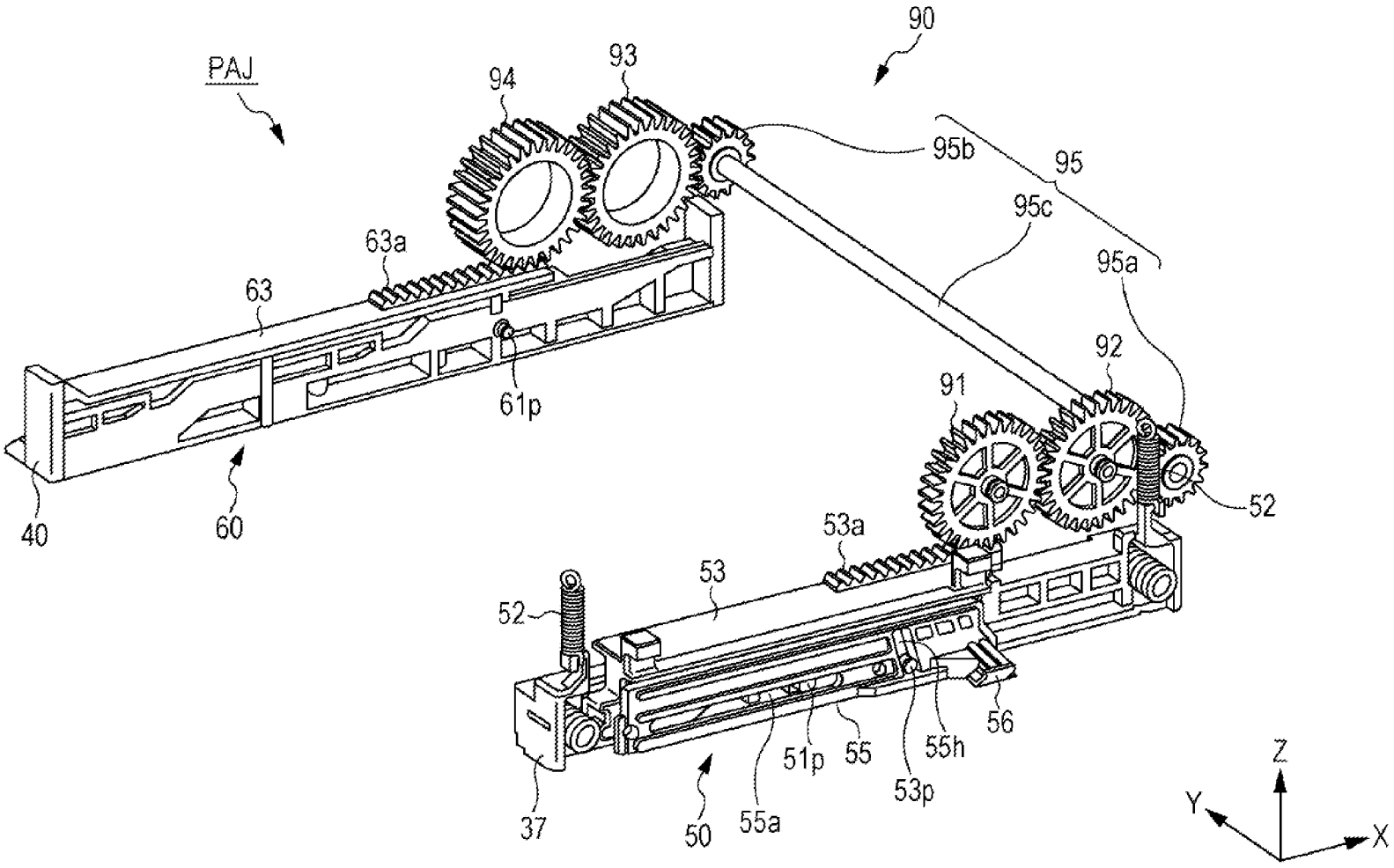
FIG. 4 is a schematic perspective view of a gap adjustment mechanism.

Further, as illustrated in FIG. 4, in the printer 11 according to the embodiment, a gap adjustment mechanism (a gap adjustment section) PAJ capable of adjusting a distance between the liquid ejecting head 18 and the sheet P on the support base 16 in the vertical direction Z, that is, the gap PG between the liquid ejecting head 18 and the support base 16 (the support surface 16*a*) by adjusting a height position of the carriage 17 is provided. The gap adjustment mechanism PAJ has a first cam mechanism 50 and a second cam mechanism 60 which are separated from each other in the transportation direction Y of the sheet P, and a cam interlocking mechanism 90 which is positioned between the first cam mechanism 50 and the second cam mechanism 60, and interlocks operations of both cams.

The first cam mechanism 50 includes the first slide member 37 that slides on the upper surface 35A of the first guide section 35 of the first guide rail 20 when moving the carriage 17, a first cam member 53 that engages with the first slide member 37, and an engagement member 55 that engages with the first cam member 53. Meanwhile, the second cam mechanism 60 includes the second slide member 40 that slides on the upper surface 34A of the guide section 34 of the second guide rail 21 when moving the carriage 17, and a second cam member 63 that engages with the second slide member 40. Then, the first cam mechanism 50 including the first slide member 37 sliding with the first guide rail 20 is disposed on the upstream side in the transportation direction Y of the sheet P on the carriage 17, and the second cam mechanism 60 including the second slide member 40 sliding with the second guide rail 21 is disposed on the downstream side in the transportation direction Y of the sheet P on the carriage 17.

The cam interlocking mechanism 90 includes a first transmission gear 91, a second transmission gear 92 engaging with the first transmission gear 91, a pinion 95*a* engaging with the second transmission gear 92, a third transmission gear 93 engaging with a pinion 95*b*, and a fourth transmission gear 94 engaging with the third transmission gear 93. The first transmission gear 91 engages with a first rack 53*a* provided on an upper surface of the first cam member 53 in the first cam mechanism 50, and the fourth transmission gear 94 engages with a second rack 63*a* provided on an upper surface of the second cam member 63 in the second cam mechanism 60. The pinion 95*a* and the pinion 95*b* are connected by a gear shaft 95*c* extending between the first cam mechanism 50 and the second cam mechanism 60, and configure a pinion gear shaft 95.

One side of the cam interlocking mechanism 90 engages with the first cam mechanism 50 and the other side engages with the second cam mechanism 60. That is, the cam interlocking mechanism 90 converts a linear motion of the first rack 53*a* into a rotary motion by the first transmission gear 91 when the first rack 53*a* is displaced in the moving direction X of the carriage 17, and transmits the rotary motion that has been converted to the fourth transmission gear 94 through the second transmission gear 92, the pinion gear shaft 95 and the third transmission gear 93. The fourth transmission gear 94 transmits the rotary motion that is transmitted to the second rack 63*a* as the linear motion. The cam interlocking mechanism 90 moves the second rack 63*a* by interlocking with the first rack 53*a* in the same direction as the direction in which the first rack 53*a* is moved by the transmission.

As described above, the cam interlocking mechanism 90 is configured such that the first cam mechanism 50 and the second cam mechanism 60 are connected by a mechanism such as a plurality of gears. Then, the cam interlocking mechanism 90 transmits power of the first cam mechanism 50 that displaces the carriage 17 by interlocking with the displacement of the carriage 17 in the vertical direction in which the first cam mechanism 50 changes the gap PG to the second cam mechanism 60, and displaces the carriage 17 in the vertical direction in which the second cam mechanism 60 changes the gap PG.

Figure 5A:
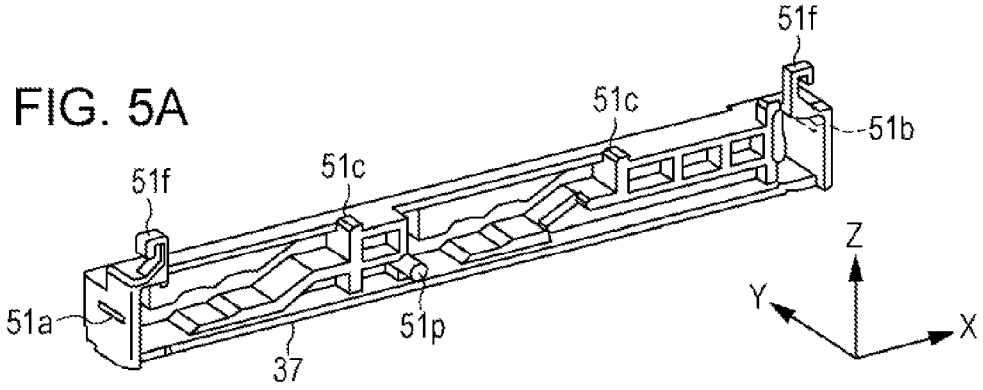
FIGS. 5A to 5D are views illustrating a configuration member of a first cam mechanism.

As illustrated in FIG. 5A, the first slide member 37 in the first cam mechanism 50 extends as the longitudinal direction thereof is the moving direction X of the carriage 17 and both end portions 51*a* and 51*b* in the longitudinal direction thereof abut an inner surface of the housing of the first sub-support section 31 in the carriage 17. Then, a relative movement of the first slide member 37 is regulated with respect to the carriage 17 in the moving direction X of the carriage 17 and a relative movement can be performed in the vertical direction Z, in a state where the both end portions 51*a* and 51*b* abut the inner surface of the housing of the carriage 17.

Further, a plurality of contacting sections 51*c* (two here) coming into contact with a first cam section 54 (see FIG. 5C) included in the first cam member 53 are provided on an upper surface of the first slide member 37. Further, a hook section 51*f* hooking a first spring member 52 is provided respectively in both end portions of the upper surface of the first slide member 37 in the longitudinal direction. That is, the first slide member 37 is biased with respect to the inner surface of the housing of the first sub-support section 31 in the carriage 17 by the first spring member 52 that is hooked in the hook section 51*f*. Further, a guide pin 51*p* for guiding moving of the engagement member 55 is provided in the first slide member 37 by protruding in the opposite direction to the transportation direction Y of the sheet P.

Figure 5B:
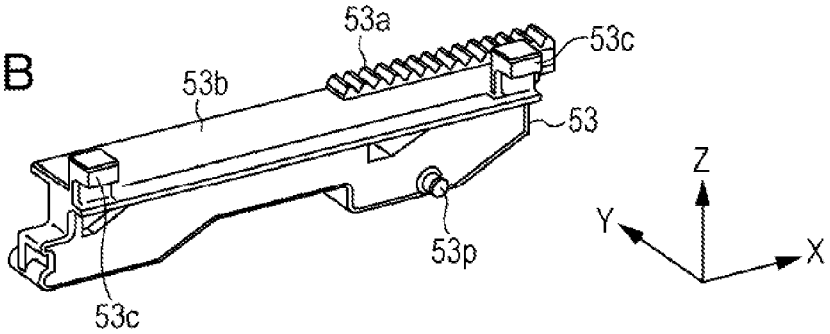
Figure 5C:
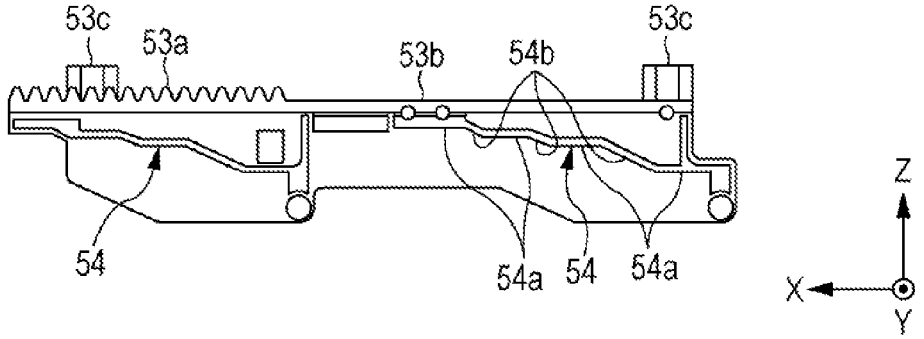

As illustrated in FIGS. 5B and 5C, the first rack 53*a* is formed on the upper surface of the first cam member 53 and a first abutting surface 53*b* that supports the first sub-support section 31 from below by abutting a part of the first sub-support section 31 in the carriage 17 is formed on the upper surface of the first cam member 53. Further, the step-shaped first cam section 54 is provided on a surface on the side of the transportation direction Y of the sheet P in the first cam member 53. Moreover, the first cam section 54 is provided so that four step sections 54*a* are connected to each other through inclined sections 54*b*.

Therefore, one of the four step sections 54*a* engages with the contacting section 51*c* of the first slide member 37 so that the first cam member 53 is relatively displaced with respect to the first slide member 37 in the vertical direction and the first sub-support section 31 supported on the first abutting surface 53*b* is displaced together therewith in the vertical direction. The gap PG is defined in the opposite direction to the liquid ejecting head 18 and the support surface 16*a* by the displacement of the first sub-support section 31 of the carriage 17. Further, when the first cam member 53 slidingly moves with respect to the first slide member 37, the contacting section 51*c* moves on the inclined sections 54*b* so that the gap PG changes.

Further, in the first cam member 53, an engagement pin 53*p* engaging with the engagement member 55 is formed on a side surface in the opposite direction to the transportation direction Y of the sheet P, and a guide portion 53*c* for guiding relative sliding movement of the first cam member 53 with respect to the first sub-support section 31 of the carriage 17 is formed.

Figure 5D:
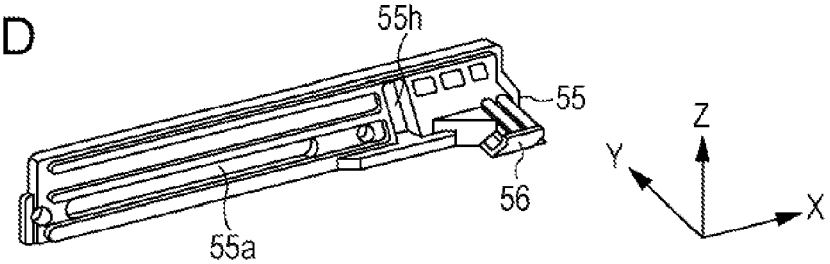

As illustrated in FIG. 5D, the engagement member 55 is formed as a plate member extending as the longitudinal direction thereof is the moving direction X of the carriage 17, and a protrusion section 56 is provided in a lower end section of the side surface in the opposite direction to the transportation direction Y. The protrusion section 56 engages with a protrusion section (not illustrated) protruding from the upper surface 35A of the first guide section 35 of the first guide rail 20 so that the engagement member 55 slidingly relatively moves along the moving direction X with respect to the first slide member 37 according to the movement of the carriage 17. Further, a long hole 55*h* into which the engagement pin 53*p* of the first cam member 53 is loosely inserted is provided in the engagement member 55. The engagement pin 53*p* is loosely inserted into the long hole 55*h* so that the first cam member 53 slidingly moves in the moving direction X of the carriage 17 together with the engagement member 55.

Figure 6A:
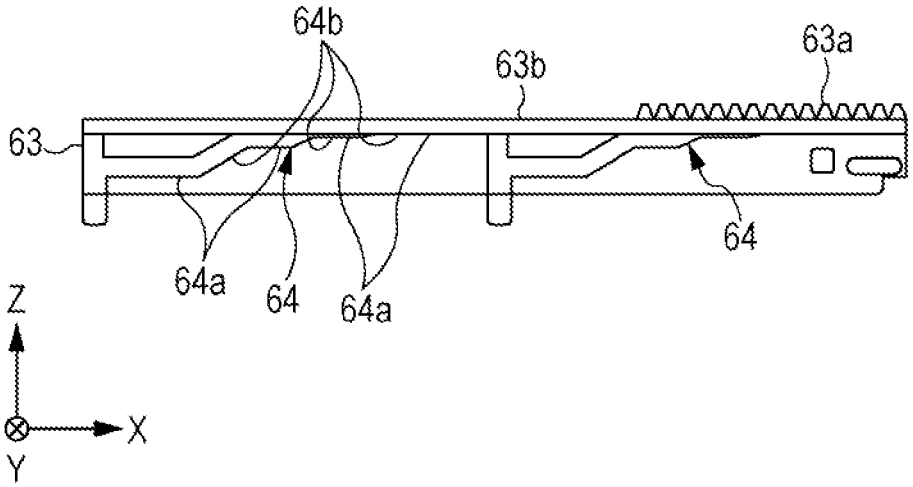
FIGS. 6A and 6B are views of a second cam mechanism.

Meanwhile, as illustrated in FIG. 6A, the second rack 63*a* is formed on the upper surface of the second cam member 63 in the second cam mechanism 60, and a second abutting surface 63*b* supporting the second sub-support section 32 from below by abutting a part of the second sub-support section 32 is formed in the carriage 17. Further, a step-shaped second cam section 64 is provided on a surface on the opposite side to the transportation direction Y of the sheet P in the second cam member 63. Moreover, the second cam section 64 is provided such that four step sections 64*a* similar to the first cam section 54 are connected to each other through inclined sections 64*b*.

Figure 6B:
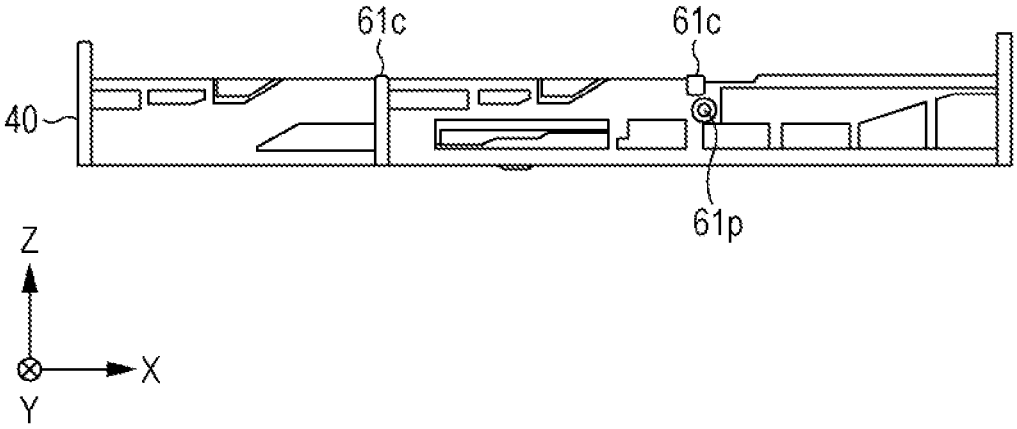

As illustrated in FIG. 6B, the second slide member 40 in the second cam mechanism 60 extends as the longitudinal direction thereof is the moving direction X of the carriage 17, and a plurality of contacting sections 61*c* (two here) coming into contact with the second cam section 64 of the second cam member 63 are provided on an upper surface of an extending portion in the longitudinal direction thereof. Further, as described above, the sliding section 40A sliding with respect to the upper surface 34A of the guide section 34 is formed in the second guide rail 21 in the side (side in the −Z direction) of the lower surface of the extending portion. Further, a regulating pin 61*p* that regulates a relative displacement of the second slide member 40 along the moving direction X with respect to the carriage 17 while allowing a relative displacement of the second sub-support section 32 of the carriage 17 with respect to the second slide member 40 in the vertical direction is provided on a surface on the opposite side to the transportation direction Y of the sheet P in the second slide member 40.

Therefore, in the second cam mechanism 60, the second cam member 63 is slidingly moved by the cam interlocking mechanism 90 so that a position in which the contacting section 61*c* of the second slide member 40 comes into contact with the second cam section 64 moves and the second cam member 63 is relatively displaced with respect to the second slide member 40 depending on the contacting position that is moved in the vertical direction. Then, the second sub-support section 32 of the carriage 17 supported on the second abutting surface 63*b* of the second cam member 63 is displaced together with the displacement of the second cam member 63 vertically so that the gap PG is defined in the opposite direction to the liquid ejecting head 18 and the support surface 16*a*. Further, when the second cam member 63 slidingly moves with respect to the second slide member 40, the contacting section 61*c* moves on the inclined sections 64*b* so that the gap PG changes.

In the change in the gap PG, the cam interlocking mechanism 90 transmits the slide movement of the first cam member 53 to the slide movement of the second cam member 63 so that the displacement of the first sub-support section 31 of the carriage 17 by the first cam mechanism 50 in the vertical direction is synchronized with the displacement of the second sub-support section 32 of the carriage 17 by the second cam mechanism 60 in the vertical direction. Therefore, since the first cam member 53 and the second cam member 63 are moved by interlocking each other, the gap PG is changed while the carriage 17 is displaced in a state where inclination of the carriage 17 is suppressed with respect to the support surface 16*a*.

Next, a specific configuration of the sliding sections 30B, 37A, 37B and 40A formed on the carriage 17 and each of the slide members 37 and 40 is described. Moreover, hereinafter, since an outer periphery shape of each of the sliding sections 30B, 37A, 37B and 40A is the same as each other, the sliding section 30B formed on the side surface 30A of the main support section 30 of the carriage 17 is described as a representative example, and repeated description regarding the other sliding sections 37A, 37B and 40A is omitted.

Figure 7:
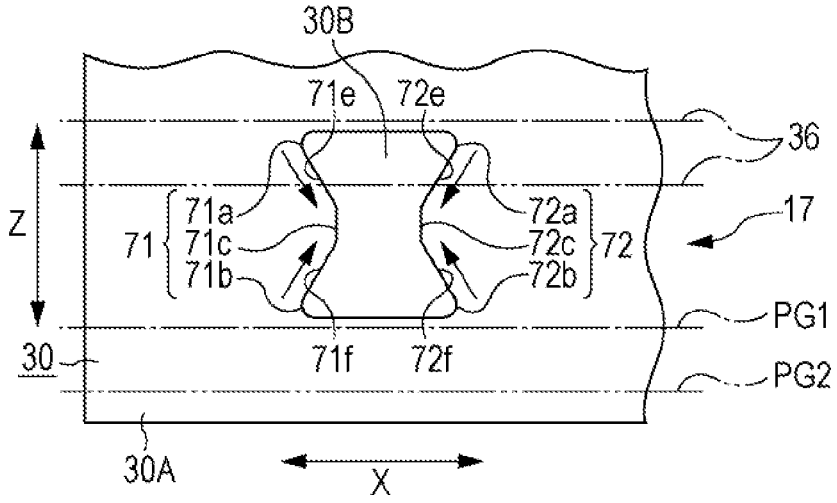
FIG. 7 is a front view illustrating a sliding section of a carriage.

As illustrated in FIGS. 3 and 7, the sliding section 30B has one side edge section 71 extending so as to cross the moving direction X in a position (the left side in FIG. 7) of one side in the moving direction X of the carriage 17, and the other side edge section 72 extending so as to cross the moving direction X in the other side position (the right side in FIG. 7) in the moving direction X, in a part of an edge section forming a contour thereof. The one side edge section 71 has an edge shape in which one end side portion 71*a* that becomes one end side (upper side in FIG. 7) and the other end side portion 71*b* that becomes the other end side (lower side in FIG. 7) in the vertical direction Z crossing the moving direction X of the carriage 17 are positioned to one side (the left side, in this case) in the moving direction X from a nearly center portion 71*c*. That is, the one side edge section 71 is configured such that an edge portion linearly connecting the one end side portion 71*a* and the nearly center portion 71*c* and an edge portion linearly connecting the other end side portion 71*b* and the nearly center portion 71*c* are formed in inclined edges 71*e* and 71*f* which are slanted to the other side (the right side, in this case) approaching the nearly center portion 71*c*, respectively.

Similarly, the other side edge section 72 has an edge shape in which one end side portion 72*a* that becomes one end side (upper side in FIG. 7) and the other end side portion 72*b* that becomes the other end side (lower side in FIG. 7) in the vertical direction Z crossing the moving direction X of the carriage 17 are positioned on the other side (the right side, in this case) in the moving direction X from a nearly center portion 72*c*. That is, the other side edge section 72 is configured such that an edge portion linearly connecting the one end side portion 72*a* and the nearly center portion 72*c* and an edge portion linearly connecting the other end side portion 72*b* and the nearly center portion 72*c* are formed in inclined edges 72*e* and 72*f* which are slanted to the one side (the left side, in this case) approaching the nearly center portion 72*c*, respectively.

Further, as illustrated in FIG. 7, even when the gap PG between the liquid ejecting head 18 and the support surface 16*a* is changed from an average gap PG1 to a gap PG2 when the carriage 17 is displaced until a displaceable limit position in the vertical direction Z, a gap adjustment width is set in the gap adjustment mechanism PAJ so that a part of the sliding section 30B maintains a sliding state with the second guide section 36. That is, when the gap PG is the average gap PG1, the second guide section 36 is in a position state with respect to the sliding section 30B illustrated in a one-dot chain line in FIG. 7 and an entirety of the sliding section 30B is positioned within the width of the second guide section 36. On the other hand, when the gap PG is the gap PG2 of the adjustable limit, the second guide section 36 is in a position state illustrated in a two-dot chain line in FIG. 7 with respect to the sliding section 30B, and an entirety of the edges 71*f* and 72*f* on the lower side and a part of the edges 71*e* and 72*e* on the upper side of the sliding section 30B in the vertical direction Z are positioned within the width of the second guide section 36 together with the nearly center portions 71*c* and 72*c*. Thus, even when the gap PG is adjusted to the gap PG2 of the adjustable limit, in the one side edge section 71 and the other side edge section 72 of the sliding section 30B, one side portions (the other end side portions 71*b* and 72*b* in FIG. 7) among the one end side portions 71*a* and 72*a*, and the other end side portions 71*b* and 72*b*, and the nearly center portions 71*c* and 72*c* maintain the sliding state with the second guide section 36 in which the grease 41 is interposed.

Next, an operation of the printer 11 having the above configuration is described by particularly focusing on the operations of the sliding sections 30B, 37A, 37B and 40A in a case where the carriage 17 is moved in the moving direction X.

Now, in a state where the grease 41 is applied to each of the surfaces 34A, 35A, 36A and 36B functioning as the slide members in each of the guide sections 34, 35 and 36 of the first guide rail 20 and the second guide rail 21, when the carriage 17 is moved in the moving direction X, each of the sliding sections 30B, 37A, 37B and 40A slides on an applied region of the grease 41. In this case, each of the sliding sections 30B, 37A, 37B and 40A integrally moves with the carriage 17 while pushing the grease 41 applied to each of the surfaces 34A, 35A, 36A and 36B of each of the guide sections 34, 35 and 36 forward in the moving direction X. Hereinafter, the sliding section 30B among the sliding sections 30B, 37A, 37B and 40A, which is formed on the side surface 30A of the main support section 30 of the carriage 17 is described as a representative example.

Now, in the state illustrated in FIG. 7, when the carriage 17 is moved to the one side (the left side in FIG. 7) in the moving direction X, the sliding section 30B progresses in the moving direction X of the carriage 17 while the one side edge section 71 positioned on the front side in a progressing direction in this case widely pushes the grease 41 applied on the second surface 36B of the second guide section 36. Then, in this case, the grease 41 interposed in a region between the one end side portion 71*a* and the other end side portion 71*b* of the one side edge section 71 is scraped up in the vicinity of the nearly center portion 71*c* by being guided to the nearly center by the edge portions which are inclined from the one end side portion 71*a* and the other end side portion 71*b* to the nearly center portion 71*c*. Thus, oil is ensured between the second surface 36B of the second guide section 36 and the sliding section 30B by the scraped grease 41.

Meanwhile, in the state illustrated in FIG. 7, when the carriage 17 is moved to the other side (the right side in FIG. 7) in the moving direction X, the sliding section 30B progresses in the moving direction X of the carriage 17 while the other side edge section 72 positioned on the front side in a progressing direction in this case widely pushes the grease 41 applied on the second surface 36B of the second guide section 36. Then, in this case, the grease 41 interposed in a region between the one end side portion 72*a* and the other end side portion 72*b* of the other side edge section 72 is scraped up in the vicinity of the nearly center portion 72*c* by being guided to the nearly center by the edge portions which are inclined from the one end side portion 72*a* and the other end side portion 72*b* to the nearly center portion 72*c*. Thus, oil is ensured between the second surface 36B of the second guide section 36 and the sliding section 30B by the scraped grease 41.

Further, when the gap PG between the liquid ejecting head 18 and the support surface 16*a* is adjusted to the gap PG2 of the adjustable limit by the gap adjustment mechanism PAJ, in the one side edge section 71 and the other side edge section 72 of the sliding section 30B, there is a concern that one (the one end side portions 71*a* and 72*a* in FIG. 7) of the one end side portions 71*a* and 72*a*, and the other end side portions 71*b* and 72*b* may be separated from the second guide section 36. However, even in this case, the other portion (the other end side portions 71*b* and 72*b* in FIG. 7) and the nearly center portions 71*c* and 72*c* maintain the sliding state with the second guide section 36.

For example, when the carriage 17 is displaced until the upper limit position when adjusting the gap, an entirety of the edges 71*f* and 72*f* on the lower side, and a substantially lower half of the edges 71*e* and 72*e* of the upper side of the sliding section 30B together with the nearly center portions 71*c* and 72*c* in the one side edge section 71 and the other side edge section 72 are positioned in positions capable of sliding with the second guide section 36. Then, conversely, when the carriage 17 is displaced until the lower limit position when adjusting the gap, an entirety of the edges 71*e* and 72*e* on the upper side, and a substantially upper half of the edges 71*f* and 72*f* of the lower side of the sliding section 30B together with the nearly center portions 71*c* and 72*c* in the one side edge section 71 and the other side edge section 72 are positioned in positions capable of sliding with the second guide section 36.

Thus, the grease 41 interposed in the region between at least the other portion (the other end side portions 71*b* and 72*b*, in this case) and the nearly center portions 71*c* and 72*c* is scraped up in the vicinity of the nearly center portions 71*c* and 72*c* by being guided to the nearly center by the edge portions which are inclined from the other portions (the other end side portions 71*b* and 72*b*) to the nearly center portions 71*c* and 72*c*. Thus, even in this case, oil is ensured between the second surface 36B of the second guide section 36 and the sliding section 30B by the scraped grease 41.

According to the embodiment, it is possible to obtain effects as described below.

(1) If the grease 41 is applied to the surface of each of the guide sections 34, 35 and 36 of the guide rails 20 and 21, it is possible to scrape up the grease 41 by the sliding sections 30B, 37A, 37B and 40A, even when the carriage 17 is moved in any direction of to the one side and to the other side in the moving direction X. That is, it is possible to scrape up the grease 41 in the vicinity of the nearly center portions 71*c* and 72*c* between the one end side portions 71*a* and 72*a*, and the other end side portions 71*b* and 72*b* in the edges thereof by one of the one side edge section 71 and the other side edge section 72 in the sliding section. Therefore, it is possible to suppress wear of the guide sections 34, 35 and 36 or the sliding sections 30B, 37A, 37B and 40A by ensuring oil between the guide sections 34, 35 and 36, and the sliding sections 30B, 37A, 37B and 40A which slide when the carriage 17 is moved.

(2) Even when the gap PG between the support surface 16*a* and the liquid ejecting head 18 is adjusted by the gap adjustment mechanism PAJ, and the carriage 17 is displaced until the limit position in which the carriage 17 is capable of being displaced in the direction in which the support surface 16*a* faces the liquid ejecting head 18, it is possible to collect the grease in the vicinity of the nearly center portions 71*c* and 72*c* in the edge sections 71 and 72 of the sliding section. Therefore, it is possible to suppress wear of the guide sections 34, 35 and 36 or the sliding sections 30B, 37A, 37B and 40A by oil.

(3) Even when the carriage 17 is displaced to the upper limit position or the lower limit position according to the gap adjustment by the gap adjustment mechanism PAJ, it is possible to collect the grease 41 in the vicinity of the nearly center portions 71*c* and 72*c* from both sides of the one end side and the other end side in the vertical direction Z in each of the edge sections 71 and 72 of the sliding sections 30B, 37A, 37B and 40A.

(4) Generally, although the grease 41 interposed between the guide section 36 and the sliding sections 30B and 37B along the vertical direction is likely to flow downward by being affected by gravity, it is possible to secure the oil between the guide section 36 and the sliding sections 30B and 37B in the vertical direction by a relatively large amount of the grease 41 applied to such places over a long period of time.

Moreover, the embodiment described above may be modified to the following other embodiments.

Figure 8:
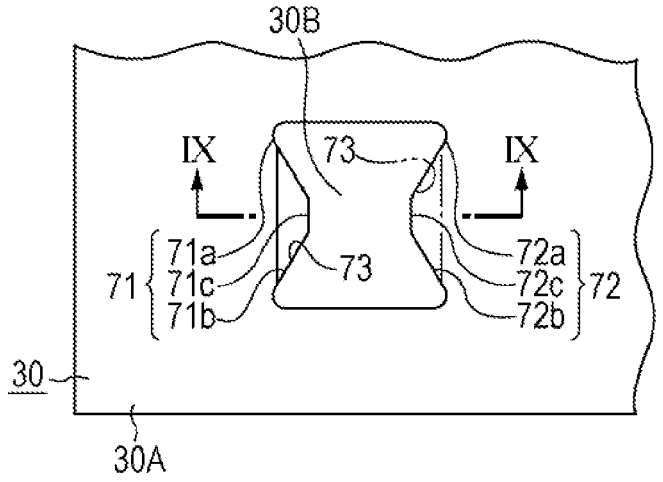
FIG. 8 is a front view illustrating a sliding section of a first modification example.
Figure 9:
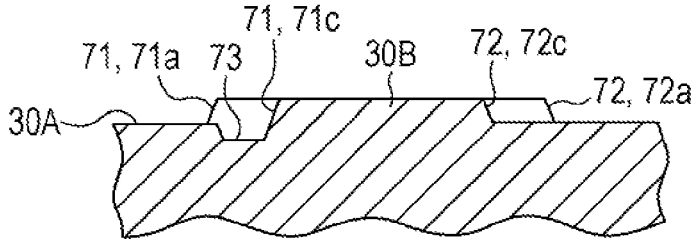
FIG. 9 is a cross-sectional view taken along an arrow of line IX-IX in FIG. 8.

As the first modification example illustrated in FIGS. 8 and 9, at least one edge portion of one side edge section 71 and the other side edge section 72 of a sliding section 30B, a concave section 73 recessed from a side surface 30A of a carriage 17 may be provided between one end side portions 71*a* and 72*a*, the other end side portions 71*b* and 72*b*, and nearly center portions 71*c* and 72*c*. According to the configuration, since grease 41 that is scraped up from a surface of a second guide section 36 by the one side edge section 71 and the other side edge section 72 of the sliding section 30B is collected in the concave section 73 according to the movement of the carriage 17, it is possible to secure the oil between a guide section 36 and the sliding section 30B by the grease 41 collected in the concave section 73.

Figure 10:
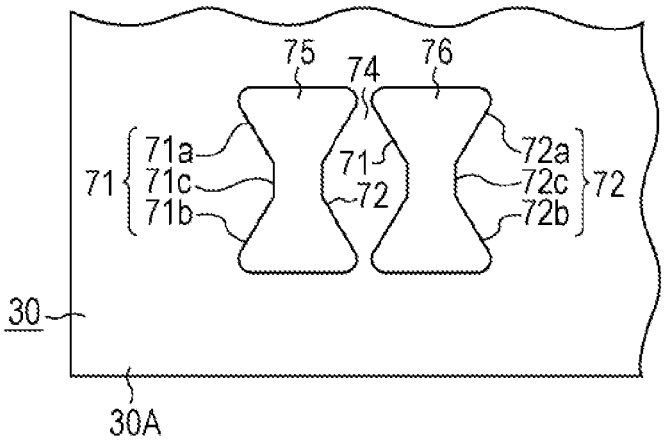
FIG. 10 is a front view illustrating a sliding section of a second modification example.

As a second modification example illustrated in FIG. 10, a sliding section may be configured of a plurality (two in this case) of sliding sections 75 and 76 so as to be adjacent to each other in a moving direction X of a carriage 17 across a groove section 74 extending crossing the moving direction X. According to the configuration, it is possible to ensure oil between a guide section 36 and the sliding sections 75 and 76 by grease 41 flowed and collected into the groove section 74 between both sliding sections 75 and 76 adjacent to each other in the moving direction X of the carriage 17.

Figure 11:
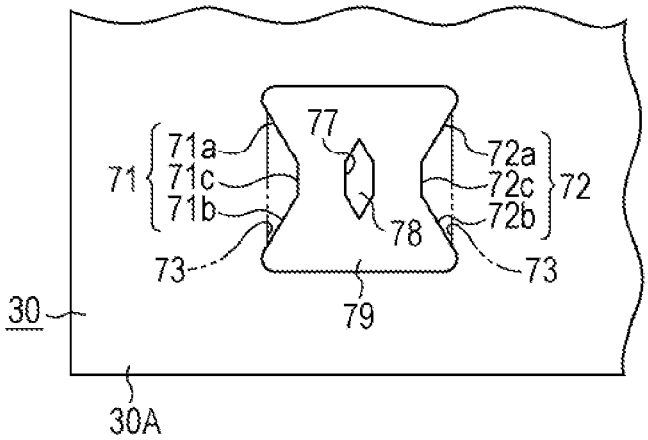
FIG. 11 is a front view illustrating a sliding section of a third modification example.

As a third modification example illustrated in FIG. 11, a sliding section may be a sliding section 79 having a concave section 78 surrounded by a circular edge section 77 between one side edge section 71 and the other side edge section 72 in a moving direction X of a carriage 17. According to the configuration, since the sliding section 79 can utilize the concave section 78 surrounded by the circular edge section 77 as a grease reservoir, in this respect, it is possible to ensure oil between a guide section 36 and the sliding section 79.

Figure 12:
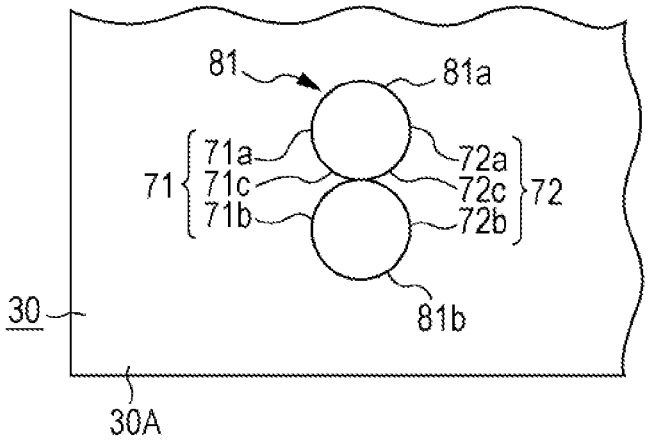
FIG. 12 is a front view illustrating a sliding section of a fourth modification example.

As a fourth modification example illustrated in FIG. 12, a sliding section may be a sliding section 81 configured of a plurality (two in this case) of circular protrusion sections 81*a* and 81*b* adjacent to each other in a direction orthogonal to a moving direction X of a carriage 17. Even in this case, since a sliding section 81 has one side edge section 71 and the other side edge section 72 having the same configuration as the case of the sliding section (for example, the sliding section 30B) of the embodiment, it is possible to obtain the same effects as the embodiment.

Figure 13:
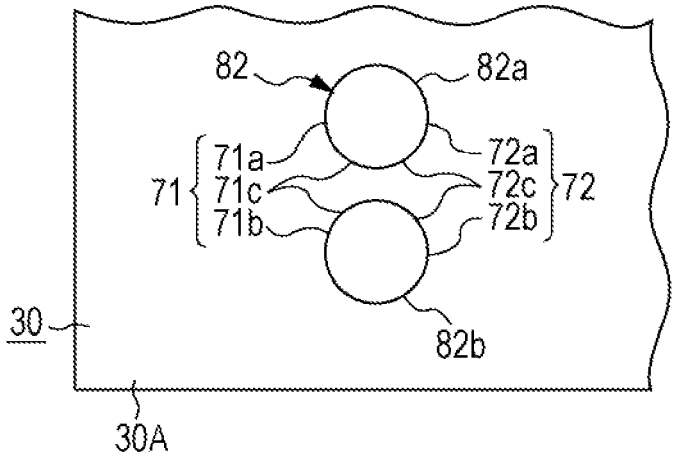
FIG. 13 is a front view illustrating a sliding section of a fifth modification example.

As a fifth modification example illustrated in FIG. 13, a sliding section may be a sliding section 82 configured of a plurality (two in this case) of circular protrusion sections 82*a* and 82*b* adjacent to each other with a gap therebetween in a direction orthogonal to a moving direction X of a carriage 17. Even in this case, since a sliding section 82 has one side edge section 71 and the other side edge section 72 having the same configuration as the case of the sliding section (for example, the sliding section 30B) of the embodiment, it is possible to obtain the same effects as the embodiment.

Figure 14:
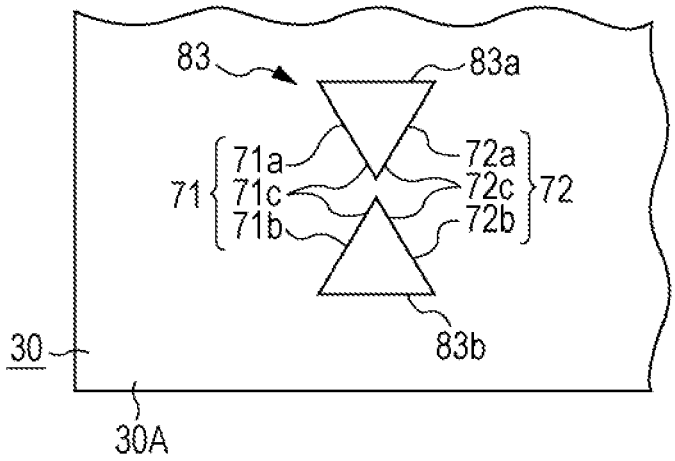
FIG. 14 is a front view illustrating a sliding section of a sixth modification example.

As a sixth modification example illustrated in FIG. 14, a sliding section may be a sliding section 83 configured of a plurality (two in this case) of polygonal (triangular in this case) protrusion sections 83*a* and 83*b* adjacent to each other with a gap therebetween in a direction orthogonal to the moving direction X of a carriage 17. Even in this case, since a sliding section 83 has one side edge section 71 and the other side edge section 72 having the same configuration as the case of the sliding section (for example, the sliding section 30B) of the embodiment, it is possible to obtain the same effects as the embodiment.

Figure 15:
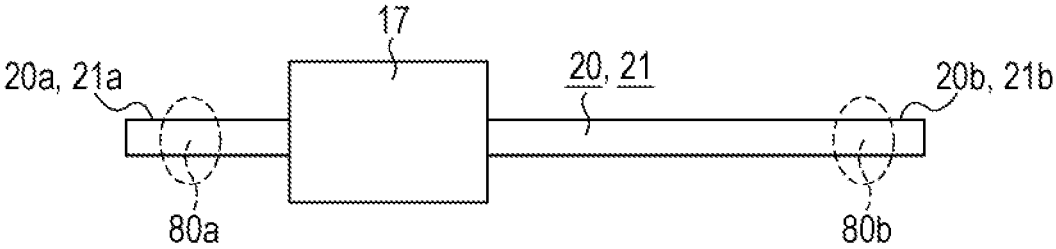
FIG. 15 is a schematic view illustrating a printer of another modification example.

As illustrated in FIG. 15, the grease may be applied to portions 80*a* and 80*b* near both end sections 20*a* and 20*b* (21*a* and 21*b*) in a longitudinal direction of a guide rail 20 (21) greater than the other portions. In this case, when a carriage 17 is moved in a moving direction X, in both end portions 20*a* and 20*b* (21*a* and 21*b*) of the guide rail 20 (21), it is possible to incorporate wear powder attached to a sliding section 30B of the carriage 17 into the grease in portions 80*a* and 80*b* near both end portions 20*a* and 20*b* (21*a* and 21*b*).

An amount of the grease interposed between the sliding sections 30B and 37B which are vertical sliding sections and the surfaces 36A and 36B of the guide section 36 which is the slide section along the vertical direction may not be greater than an amount of the grease interposed between the sliding sections 37A and 40A which are the horizontal sliding sections, and the surfaces 34A and 35A of the guide sections 34 and 35 which are the slide sections along the horizontal direction.

As illustrated in a two-dot chain line in FIG. 8, the concave section 73 that is a reservoir of the grease is not provided on the side of the one side edge section 71 but may be provided on the side of the other side edge section 72. Further, as illustrated in a two-dot chain line in FIG. 11, the concave sections 73 may be provided respectively on the side of the one side edge section 71 and on the side of the other side edge section 72.

For example, shapes of the concave sections 73 and 78, and the groove section 74 which are the reservoirs of the grease may be changed to such as a circular shape in addition to the shapes of the embodiments.

In the sliding sections 30B, 37A, 37B and 40A, the shape of the edges of the one side edge section 71 and the other side edge section 72 may be a semi-circular arc shape in which the nearly center portion is a bottom section thereof, if the shape of the edges is configured such that the one end side portions 71*a* and 72*a*, and the other end side portions 71*b* and 72*b* are positioned on the front side in the moving direction of the carriage 17 with respect to the nearly center portions 71*c* and 72*c* when the carriage 17 is moved.

In the above embodiments, the recording apparatus is embodied in the printer 11 having the liquid ejecting head 18 ejecting the ink, but a liquid ejecting apparatus may be embodied to eject a liquid other than the ink. The invention may be applied to various types of liquid ejecting apparatuses including a liquid ejecting head or the like ejecting a small amount of liquid droplets. In addition, liquid droplets are referred to as states of the liquid ejected from the liquid ejecting apparatus described above and also include liquids trailing in a granular shape, a tear shape and a thread shape. In addition, the liquid referred to herein may be a material which can be ejected from the liquid ejecting apparatus. For example, a material may be used as long as the material is in a state of a liquid phase. In addition, the material includes liquid material having high or low viscosity, a flow-shape material such as a sol, gel water, an inorganic solvent, an organic solvent, a solution, liquid-shaped resin, liquid-shaped metal (melt metal), and not only a liquid as a material of one state but also a material in which particles of functional material consisting of solids such as pigments or metal particles are dissolved in, dispersed in, or mixed into a solvent. In addition, a representative example of the liquid includes the ink described in the above embodiment, a liquid crystal or the like. Here, the ink is intended to include various types of liquid compositions such as general water-based ink, oil-based ink, gel ink and hot melt ink. A specific example of the liquid ejecting apparatus includes, for example, a liquid ejecting apparatus ejecting liquid including a material in a form of a dispersion or a solution such as an electrode material or a color material that is used to manufacture a liquid crystal display, an electroluminescence (EL) display, a surface emitting display and a color filter. Alternatively, the liquid ejecting apparatus may be a liquid ejecting apparatus ejecting a bioorganic material used for biochip manufacturing, a liquid ejecting apparatus ejecting liquid which is a sample used as a precision pipette, a printing apparatus, a micro-dispenser or the like. Furthermore, the liquid ejecting apparatus may employ a liquid ejecting apparatus ejecting lubricant at a pin point to a precision machine such as a watch or a camera, a liquid ejecting apparatus ejecting transparent resin liquid such as an ultraviolet curing resin to form a micro hemispherical lens (an optical lens) used for an optical communication device or the like on a substrate, and a liquid ejecting apparatus ejecting etching liquid such as acid or alkali to etch a substrate or the like. Then, the invention may be applied to any one of the liquid ejecting apparatuses.

The entire disclosure of Japanese Patent Application No. 2013-142739, filed Jul. 8, 2013 is expressly incorporated by reference herein.

What is claimed is:

1. A recording apparatus comprising:

a recording section that performs recording with respect to a medium;

a moving body that is equipped with the recording section and reciprocates with respect to the medium in a main scanning direction;

a guide section that extends in the main scanning direction and guides movement of the moving body in the main scanning direction; and a sliding section that is provided so as to integrally move with the moving body and slides on the guide section to which a lubricant is applied when the moving body is moved, wherein the sliding section has one side edge section that extends so as to cross the main scanning direction in a position of one side in the main scanning direction and the other side edge section that extends so as to cross the main scanning direction in a position of the other side in the main scanning direction, wherein in the one side edge section, one end side portion and the other end side portion in a direction crossing the main scanning direction are positioned on the one side in the main scanning direction from a nearly center portion, and wherein in the other side edge section, one end side portion and the other end side portion in a direction crossing the main scanning direction are positioned on the other side in the main scanning direction from a nearly center portion.

2. The recording apparatus according to claim 1, further comprising:

a support section that has a support surface capable of supporting the medium in a state of facing the recording section; and a gap adjustment section that is capable of adjusting a gap between the support surface and the recording section by displacing the moving body in a direction in which the support surface faces the recording section, wherein in a state where the moving body is displaced until a displaceable limit position in a direction in which the support surface faces the recording section according to adjustment of the gap by the gap adjustment section, each edge section of the sliding section maintains a state where at least one of the one end side portion and the other end side portion, and the nearly center portion are capable of sliding with respect to the guide section.

3. The recording apparatus according to claim 2, wherein in a case where the moving body is displaced in a vertical direction according to the adjustment of the gap by the gap adjustment section, when the moving body is displaced until the upper limit position, each edge section of the sliding section maintains a position state in which at least a part of edge portions connecting portions which are positioned on the upper side in the one end side portion and the other end side portion, and the nearly center portions is capable of sliding on the guide section, and when the moving body is displaced until the lower limit position, each edge section of the sliding section maintains a position state in which at least a part of edge portions connecting portions which are positioned on the lower side in the one end side portion and the other end side portion, and the nearly center portions is capable of sliding on the guide section.

4. The recording apparatus according to claim 1, wherein in at least one edge section of the one side edge section and the other side edge section of the sliding section, a concave section is provided between the one end side portion and the other end side portion, and the nearly center portion.

5. The recording apparatus according to claim 1, wherein the sliding section is configured of a plurality of sliding sections provided adjacent to each other in the main scanning direction across a groove section extending in a direction crossing the main scanning direction.

6. The recording apparatus according to claim 1, wherein the sliding section has a concave section of which a circumference is surrounded by a circular edge section between the one side edge section and the other side edge section in the main scanning direction.

7. The recording apparatus according to claim 1, wherein the sliding section includes a vertical sliding section that slides on a vertical surface with respect to the guide section and a horizontal sliding section that slides on a horizontal surface with respect to the guide section, and when the lubricant is applied between each sliding section and the guide section, an applied amount of the lubricant between the vertical sliding section and the guide section is greater than that of the lubricant between the horizontal sliding section and the guide section.

* * * * *